United States Patent [19]

Boiko

[11] Patent Number: 5,068,017

[45] Date of Patent: Nov. 26, 1991

[54] METHOD TO DISSOLVE SOLID IRON OXIDES

[76] Inventor: Robert S. Boiko, 4200 W. Lake Ave., Apt. 306-C, Glenview, Ill. 60025

[21] Appl. No.: 702,250

[22] Filed: May 17, 1991

Related U.S. Application Data

[63] Continuation-in-part of Ser. No. 402,869, Sep. 5, 1989.

[51] Int. Cl.[5] ..... C25F 1/06

[52] U.S. Cl. ..... 204/145 R

[58] Field of Search ..... 204/145 R

[56] References Cited

U.S. PATENT DOCUMENTS

| | | | |
|---|---|---|---|
| 1,195,704 | 8/1916 | Marino | 204/145 R |
| 4,264,418 | 4/1981 | Wood et al. | 204/145 R |
| 4,544,462 | 10/1985 | Furutani et al. | 204/145 R |

*Primary Examiner*—T. M. Tufariello

*Attorney, Agent, or Firm*—Emrich & Dithmar

[57] ABSTRACT

A sample of hematite ($Fe_2O_3$) is submerged in a solution containing about 14–55% by volume $H_3PO_4$ balance water, or 12–45% by weight of $H_3C_6H_5O_7$ and water, or a combination of both acids. A negative direct current electron flow above about 12 milliamps is established to the hematite as a cathode. The positive electrode can be constructed of copper to reduce oxygen emission from the reaction and is located in proximity but elsewhere. After a reaction time of about 60–120 minutes at about a 30 volt continuous direct charge, a weight loss of about from 0.3–0.5 grams should be measured from the hematite. An increase in current increases weight loss per comparable time unit measure.

20 Claims, No Drawings

METHOD TO DISSOLVE SOLID IRON OXIDES

This application is a continuation-in-part of U.S. patent application Ser. No. 402,869, filed Sept. 5, 1989.

BACKGROUND OF THE INVENTION

Under certain conditions which are generally known, there is a formation of solid ferric oxide ($Fe_2O_3$) and or formation of ferrosoferric oxide ($Fe_2O_3.FeO$) which forms on some iron containing materials in contact with water. These iron oxides can be especially troublesome when water flow passages are diverted or blocked partially or more. One example of this type of blockage and the problem that this blockage creates would be a steel, or coated steel storage tank connected via iron or copper pipe to a copper coil, and/or coil and heat exchanger, or heat exchange only hot water heater. Normally, this system contains a circulating pump which causes a velocity flow between the storage tank and the water heater of the described type. The turbulence caused by this water flow can agitate or break loose iron oxide chunks from a corroded steel source, which may be carried into the passages of the copper coil type water heater and lodge therein causing a blockage preventing the proper flow of water through the water heater. This condition can bring about extreme heat rise, steam flashes, copper heat stress and failure, and possibly an explosion. Many times the entire blocked coil and or heat exchanger must be replaced since there is currently no recognized chemical method to remove the iron oxide, which does not simultaneously destroy the copper tubing and/or result in the evolution of noxious gases.

Where possible, physical methods of iron oxide removal are attempted, though often this is impractical. Methods to remove these chunks have included where possible, tear down of a heat exchanger where the water heater design includes header plates, the trial of high pressure back flushing, and/or the nearly impractical removal of U-bends where 16 or more might have to be unbrazed and then rebrazed. These very expensive and time consuming methods are the best available up to this time and the complete replacement of the coil or heat exchanger is often necessary.

Slight chemical action has been reported with very small amounts in the microgram or low milligram range of iron oxides tested. Some of these results have been the basis for products which are sold as rust removers, or rust stain removers. Very little activity against solid iron oxide of the type described in this invention occurs when these chemicals are tested.

Moreover, in a commercial environment, days or months are far too long for a chemical reaction to occur. Reasonably, a hot water heater should be repaired in a matter of hours, not days. Alkaline solutions of such chelating and sequestering agents as sodium glucoheptonate, sodium gluconate, sodium polyphosphates seqlene 270, seqlene ES-50, acidic solutions of ethylenediaminetetraacetic acid (EDTA) showed no reaction or weight loss to the iron oxide samples after contact time exceeding 336 hours. It is reported that an effective method of dissolving iron oxide is to place it in near boiling concentrated hydrochloric acid. Nitric and sulfuric acids are claimed to have very little or no effect on solid iron oxide. Concentrated near boiling hydrochloric acid cannot be used in a copper system since it also dissolves copper. The extreme toxicity, corrosive, and poisonous nature coupled with the difficulty of available safe engineering controls, precludes the use of this material in a routine manner.

SUMMARY OF THE INVENTION

Accordingly, an object of this invention is to provide an improved method of dissolving solid iron oxides from heat exchange coils. The method includes the use of one or both of two chemically and electrolytically stable chemicals, namely, phosphoric acid ($H_3PO_4$) and citric acid ($H_3C_6H_5O_7$) along with a direct electrical current where a negative electron flow is passed through the iron oxide.

Another object of the invention is to provide a method of combining these particular chemicals and a current flow to produce a reaction where substantial weight loss to the iron oxide occurs in a time interval of about 2–4 hours. There is no measurable reaction when the phosphoric or citric acids contact the iron oxides without the direct current, and no effect when a direct current is used without the phosphoric and/or citric acids, in a water solution only.

During the research on which this application is based, other acids were tested for effect. In many situations rapid to explosive decomposition resulted. Sulfuric, nitric, hydrochloric, sulfamic decomposed into acid anhydrides evolving very toxic fumes, certain very toxic nitrogen oxides were also formed. It is imperative that these materials not be subjected to the reaction conditions outlined herein.

The phosphoric acid and citric acids showed no decomposition under the tested voltage conditions, and were very mild in the specified concentrations to copper.

DETAILED DESCRIPTION OF THE INVENTION

This invention relates to a method of dissolving solid iron oxides even in the dense concentrated form of hematite rock and magnetite rock. The oxide composition is mainly $Fe_2O_3$ and $Fe_2O_3.FeO\ xH_2O$. Certain concentrations of phosphoric acid ($H_3OF_4$) and/or citric acid ($H_3C_6H_5O_7$) are brought into contact with the iron oxide deposits. A direct negative electrical current usually greater than 25 volts but generally in the 20–200 volt range is then passed through the iron oxides for the duration of the desired reaction. The positive electrode located elsewhere in the solution should be comprised of a suitable material, such as copper.

After 2–4 hours of contact time, substantial reduction in the weight of the iron oxide will result in a reduction of size where the iron oxide remaining can be possibly removed from where it had been lodged without further reaction time by the use of normal flushing procedures. The negative direct current passing through copper or other passages, if this method is used to reduce or remove iron oxides from those types of components, is cathodic in nature. This cathodic protection will not promote electrolytic corrosion of these surfaces.

The invention consists of certain novel features and a combination of parts hereinafter fully described, and particularly pointed out in the appended claims, it being understood that various changes in the details may be made without departing from the spirit, or sacrificing any of the advantages of the present invention.

A basic observation of the reaction and its results can be obtained by following the general description here stated. An individual(s) with the proper engineering and scientific background can adapt this information to his specific situation and use. Proper safety precautions should be observed regarding electrical supplies, wiring, personal contact, government and other chemical safety information, proper venting of flammable gas evolution, and any other safety procedures which are proper to employ in the use of this method. Other chemicals may produce toxic decomposition products from electrical and other decomposition and should be avoided.

A section of hematite ($Fe_2O_3$) measuring about 7.6 cm × 5 cm × 1.27 cm was placed about ½ submerged in a solution comprised of about 14% to 55% phosphoric acid ($H_3PO_4$) and water, or about 12% to 45% citric acid ($H_3C_6H_5O_7$) by weight in water, or any proportion of the two solutions. A direct current flow of from about 20 volts negative (electron flow) to about 150 volts, or more if generation equipment allows, was passed to and through the iron oxide where the connection to the electron current was made above the submerged portion to reduce current flow for this observation. The positive electrode was placed elsewhere in proximity and was comprised of copper. The hematite, $Fe_2O_3$, reacted with the phosphoric and/or citric acids only while the current flow was maintained. The reaction rate showed an increase with increasing current, higher voltage, and a decreased reaction rate with decreasing current, decreasing voltage based on the tested voltages to about 150 volt DC, which was the test limit. Theoretically, voltages to about 200 volts could be used.

The resistance of the hematite form of iron oxide to the passage of electrical current will cause a reading of about 25–75 milliamps if an ammeter is in use, at about 50 volts of direct current electron flow to the iron oxide. After a time of reaction exceeding each 60–120 minute unit, a weight loss of 0.3–0.5 grams has been observed when the hematite was checked for activity. It has also been observed that no measurable weight loss occurred when the hematite is incorrectly placed as the positive electrode.

When the hematite or magnetite forms of iron oxide are completely submerged in the described solution, the need for higher direct current levels is brought about. Upon submersion, solution resistance, much more than iron oxide resistance determines the current flow. While the resistance, expressed in (ohms), will vary depending on solution concentration, quantity, reaction vessel, and electrode geometry, conductivity of reaction vessel, degree of iron oxide percent present, and possibly other factors, an ohms resistance factor of from about 1.5–5 ohms has been experienced. This means that if using the 1.5 ohm figure, the power supply would have to be able to provide 20 amperes at 30 volts of direct current, 33.3 amperes at 50 volts, 100 amperes at 150 volts of direct current or 133 amperes at 200 volts. This large current draw at larger voltages will in many instances limit the size of the voltage which can be supplied for the reaction. Also to be accounted for is the possible formation of gasses from water decomposition. At a rate of 33.3 amperes, possibly 6.94 liters oxygen at S.T.P., and 13 91 liters of hydrogen at S.T.P. will evolve. Examples of an application of this invention are herewith given.

A coil and/or heat exchanger water heater can become blocked with iron oxide chunks when it is connected to storage tank which contains substantial corrosion. This can happen when a brand new water heater is installed to a corroded iron bearing tank and piping system. The turbulence from the force circulation pump can break loose iron oxides and cause the oxides to enter the coil and/or heat exchanger. The blockage can cause the need for replacement of the coil and/or heat exchanger. With the use of this invention, the iron oxide chunks lodged in the waterways of the heater can be reduced in size so that flushing or backflushing will remove the remaining material, or dissolve completely if more time is allotted.

One brand of water heater contains four separate passageways and can hold about 4–5 gallons of liquid. For servicing according to the invention, the unit would is disconnected from the inlet and outlet piping. A deliming circulating pump is thereafter attached per manufacturers instructions or a standpipe method may alternatively be used. The heater is filled with the described phosphoric and/or citric acid solution. At the bottom coil connection threaded opening, or other proper location, the negative direct current feed is attached. A voltage in the 3-70 volt range results. A positive electrode comprised of a noble connector such as silver, where possible, and electrically isolated from contact with any water heater or other surface, only contacting the solution, can be attached through the heat exchange via the use of one of the heat exchange threaded plug openings. The current is switched on and an amperage flow should occur possibly in the 3–46 ampere range. The current is left on, the solution and associated conditions monitored regularly, for about 2–4 hours, though this can vary. The solution and electrical supply is then removed from the water heater. The water heater is then flushed or backflushed. The water heater could be checked for further blockage and need for repeating the procedure by checking the heat rise through its circuits after fire-up, when the water heater is re-installed. A blockage would cause one or more of the passages to exhibit an above normal heat rise, usually more than 30–45 degrees F.

The action of phosphoric acid and/or citric acid is very mild in the recommended concentrations to copper and to steel. In certain instances, citric acid would be preferred, since it shows even less reactivity to steel than phosphoric acid.

When EDTA was tried: 1000 mls $H_2O$ to which 0.5 grams EDTA was added (not all would dissolve). $NH_3$ was added to bring above to a ph of 5. Hematite $Fe_2O_3$ starting weight 24.47 grams. 7:16 PM start, 7:40 PM Stop. One-half submerged negative current to top of piece not submerged. 49.1 volts DC from four car batteries connected in series. 18.50 milliamp current through hematite weight at stop time was unchanged. Immediate restart and continuation of above conditions until 8:40 PM, hematite again weighed. No measurable weight change to hematite in .00 gram units.

When phosphoric acid was tried: 150 mls of a 37.5% solution $H_3PO_4$ in $H_2O$. Hematite $Fe_2O_3$. Starting weight 19.52 grams. One-half submerged in solution temperature 24° C. 49.1 volts DC from four, twelve volt car batteries connected in series. Start time 4:59 AM negative current to hematite at 27.7 milliamp. Stop time 7:40 AM weight at stop 19.35 grams weight loss of 170 milligrams in time period.

Fully submerged in same chemical conditions as above phosphoric acid solution. Hematite weight 28.74 grams voltage 2.48 DC negative current to hematite. 450 milliamp current through amp meter to solution and to hematite. Start time 8:38 PM. Stop time 9:41 PM.

Final weight 28.70 grams weight loss of 40 milligrams in time period.

Exemplary of problem with too little current. 43.87 gram hematite piece. 4.59 milliamp current negative to hematite. One-half submerged. Solution contained 22.5% $H_3PO_4$, balance $H_2O$. Solution temperature 21° C. Start time 7:12 PM. Stop time 7:52 PM. Less than .01 gram weight loss from the magnetite.

In the one-half submerged disclosure, it should be noted from the many tests runs with this reaction at these conditions that a negative direct current of not less than about 12 milliamps is required to assist the reaction in the phosphoric and/or citric acids. The reaction will proceed at temperatures of 12° C., however, higher temperatures can be useful in speeding the reaction rate.

With a fully submerged iron oxide sample at 50 volts DC and 33.3 amps the wattage would be 1665 in conditions of 1.5 ohms solution resistance. Provisions need to be made for this heating effect which can occur based on the current, a product of the impressed voltage and the resistance of the total reactant components.

Dozens of tests have been conducted with various combinations of phosphoric and citric acids, different strengths of the acid, fully and partially submerged cathodes and AC as well as DC currents. It has been found that for a commercially acceptable dissolution rate, a minimum of 12 milliamps direct current must be used, which will dissolve about 1% by weight of iron oxide (FeO, $Fe_2O_3$ and $Fe_3O_4$) per hour. When the acids are used in combination, the sum of the two must be at least equal to the minimum stated above for either of them.

When coils are clogged a reduction of the iron oxide by 1–3% by weight is most often sufficient to loosen the piece that is lodged in the coil and permit the system to be flushed. When the cathodes are fully submerged in the acid solution, less voltage is required to attain the required minimum current, but whether entirely or partially submerged, sufficient DC voltage must be employed to attain the twelve milliamp minimum. Currents as high as about 500 milliamps, have been used on partially submerged cathodic iron oxides, but generally currents of 100 milliamps or less are satisfactory. When fully submerged cathodic iron oxides are used, amperes in the range of 20–30 are commonly encountered and care must be exercised to avoid the higher current (133 amps) which will occur at high voltages (200 volts).

In addition, it well known that increasing the solution temperature will increase the chemical reaction rate, but the disadvantage is that the chemical attack on the heat exchanger walls or metal parts also increases. Temperatures in the range of from about 21° to less than the boiling point of the electrolyte are preferred.

The current charge contacting the metal surfaces in this reaction is a negative electron charge. This negative current imparts a degree of cathodic protection to the metal surface and does not accelerate the destruction of these metals. This is important from an engineering aspect, since if the reaction took place via the use of a positive charge, copper coils, or steel tanks and piping could be rapidly deteriorated. Since this reaction employs the use of a negative direct current, the copper or steel surfaces are better conserved. This explains the reason that alternating current is undesirable, and should be avoided in the commercial applications for which this invention is intended.

While there has been disclosed what is considered to be the preferred embodiment of the present invention, it is understood that various changes in the details may be made without departing from the spirit, or sacrificing any of the advantages of the present invention.

I claim:

1. A method of dissolving solid iron oxide comprising providing an electrolyte of water and not less than about 14% by volume phosphoric acid or not less than 12% by weight citric acid or a combination thereof, the balance water in contact with an anode and a cathode of the solid iron oxide to be dissolved, and applying a direct negative current of not less than about 12 milliamps between the solid iron oxide cathode and an anode for a time sufficient to dissolve a portion of the solid iron oxide.

2. The method of claim 1, wherein the current between the anode and cathode is in the range of from about 12 milliamps to about 500 milliamps and the cathode is partially submerged in the electrolyte.

3. The method of claim 2, wherein the current between the anode and cathode is not less than about 25 milliamps.

4. The method of claim 2, wherein the voltage is in the range of from about 20 volts to about 200 volts.

5. The method of claim 1, wherein the cathode is fully submerged in the electrolyte.

6. The method of claim 1, wherein the anode is copper or silver or an alloy thereof.

7. The method of claim 1, wherein the iron oxide includes FeO.

8. The method of claim 1, wherein the iron oxide includes $Fe_2O_3$.

9. The method of claim 1, wherein the iron oxide includes $Fe_3O_4$.

10. The method of claim 1, wherein the iron oxide includes FeO and $Fe_2O_3$.

11. The method of claim 1, wherein the phosphoric acid is present in an amount less than about 55% by volume.

12. The method of claim 1, wherein the citric acid is present in an amount of less than about 45% by weight.

13. In a coil for a heat exchanger clogged by deposits of iron oxide lodged inside the coil, the method of dissolving the iron oxide comprising, providing an electrolyte solution of water with one or more of phosphoric acid or citric acid present in the water in contact with the coil and the iron oxide inside the coil, the phosphoric acid being present in the amount of from about 14% by volume to about 55% by volume, said citric acid being present in the amount of from about 12% by weight to about 45% by weight, establishing a direct negative current of not less than about 12 milliamps between an anode and the deposit of iron oxide clogging the inside of the coil for a time sufficient to dissolve enough of the iron oxide to enable the coil to be flushed.

14. The method of claim 13, wherein the time necessary to unclog the coil is about 2 to about 4 hours.

15. The met hod of claim 13, wherein the electrolyte is maintained at about ambient temperature.

16. The method of claim 13, wherein the temperature of the electrolyte is elevated above ambient temperatures and below the boiling point of the electrolyte.

17. The method of claim 13, wherein 20 to 200 volts is applied across the anode and cathode.

18. The method of claim 17, wherein the current is in the range of from about 12 milliamps to about 500 milliamps.

19. The method of claim 13, wherein the current is not less than about 25 milliamps.

20. The method of claim 13, wherein the cathode of iron oxide is submerged in the electrolyte and the current does not exceed 133 amps.

* * * * *